US010117549B2

(12) United States Patent
Atalla

(10) Patent No.: US 10,117,549 B2
(45) Date of Patent: Nov. 6, 2018

(54) DISPENSER FOR ROLLED, PERFORATED, FOLDED, AND/OR INTERWOVEN BAGS, WIPES AND OTHER FLEXIBLE DISPENSIBLE MATERIALS

(71) Applicant: Bonis Opus LLC, Harrington Park, NJ (US)

(72) Inventor: Elie Atalla, Harrington Park, NJ (US)

(73) Assignee: DIVERGENT DEVICES LLC, Harrington Park, NJ (US)

( * ) Notice: Subject to any disclaimer, the term of this patent is extended or adjusted under 35 U.S.C. 154(b) by 0 days.

(21) Appl. No.: 15/117,581

(22) PCT Filed: Aug. 8, 2016

(86) PCT No.: PCT/US2016/046048

§ 371 (c)(1),
(2) Date: Aug. 9, 2016

(87) PCT Pub. No.: WO2017/213673

PCT Pub. Date: Dec. 14, 2017

(65) Prior Publication Data

US 2017/0355512 A1 Dec. 14, 2017

Related U.S. Application Data

(60) Provisional application No. 62/348,685, filed on Jun. 10, 2016.

(51) Int. Cl.

| | |
|---|---|
| ***B65D 83/08*** | (2006.01) |
| ***B65D 51/26*** | (2006.01) |
| ***A47K 10/38*** | (2006.01) |

(52) U.S. Cl.
CPC ..... *A47K 10/38* (2013.01)

(58) Field of Classification Search
CPC .. B65D 83/0805; B65D 51/26; B65D 43/163; B65D 85/672; B65D 25/10; B65D 83/00;
(Continued)

(56) References Cited

U.S. PATENT DOCUMENTS

| | | | |
|---|---|---|---|
| 2,689,059 | A | 9/1954 | Nudell |
| 4,244,493 | A | 1/1981 | Harrison |

(Continued)

FOREIGN PATENT DOCUMENTS

| | | | |
|---|---|---|---|
| CA | 2597182 | C | 11/2015 |
| CN | 2520141 | Y | 11/2002 |

(Continued)

OTHER PUBLICATIONS

International Search Report and Opinion for PCT US16/46048 dated Oct. 27, 2016.

*Primary Examiner* — William A. Rivera
(74) *Attorney, Agent, or Firm* — Thomas Heed; Heed Law Group

(57) ABSTRACT

A dispensing device includes a container retaining a dispensable material, which prevents the material from breaking prior to being dispensed or over-dispensing material by including a mechanism to slow the dispensation of the material, and also aids in breaking the material subsequent to the material exiting the container. The container has a faceplate with at least three members forming a substantially triangular aperture through which the dispensable material is fed. The three members include a pair of opposing flanges forming the triangular aperture therebetween. The pair of opposing flanges further form a substantially linear slot therebetween and contiguous with the triangular aperture, with the dispensable material further fed through the slot. Each of the pair of opposing flanges has a curved surface forming a side of the triangular aperture.

3 Claims, 14 Drawing Sheets

(58) Field of Classification Search
CPC ..... B65D 83/08; B65D 47/00; B65D 25/00; B65D 25/38; B65D 25/52; B65D 83/0811; B65D 83/0835
See application file for complete search history.

(56) References Cited

U.S. PATENT DOCUMENTS

| | | | | |
|---|---|---|---|---|
| 4,262,816 | A | 4/1981 | Margulies | |
| 4,274,573 | A | 6/1981 | Finkelstein | |
| 4,462,507 | A * | 7/1984 | Margulies | A47K 10/3818 206/210 |
| 4,846,415 | A | 7/1989 | Jernberg | |
| 5,409,181 | A * | 4/1995 | Patrick | A47K 10/3827 242/596.2 |
| 5,516,001 | A | 5/1996 | Muckenfuhs | |
| 5,938,013 | A | 8/1999 | Palumbo | |
| 6,024,323 | A * | 2/2000 | Palermo, Jr. | B65D 85/672 242/588.6 |
| 6,264,059 | B1 | 7/2001 | Requena | |
| 6,273,359 | B1 * | 8/2001 | Newman | A47K 10/32 221/303 |
| 6,536,707 | B2 * | 3/2003 | Adelakun | A47K 10/38 242/160.1 |
| 6,769,589 | B2 | 8/2004 | Paukov | |
| 7,172,093 | B2 | 2/2007 | Bando | |
| 7,252,194 | B2 * | 8/2007 | Tracy | B65D 25/10 206/395 |
| 7,481,393 | B2 * | 1/2009 | Trinko | A47F 9/042 206/409 |
| 7,762,426 | B2 | 7/2010 | Stevens | |
| 8,695,914 | B2 * | 4/2014 | Mohr | B65D 85/672 242/588.6 |
| 8,931,663 | B1 | 1/2015 | Evans | |
| D771,968 | S * | 11/2016 | Bing | D6/518 |
| 2003/0075551 | A1 | 4/2003 | Dailey | |
| 2006/0180596 | A1 | 8/2006 | Young | |
| 2007/0221778 | A1 | 9/2007 | Gullo | |
| 2013/0228588 | A1 | 9/2013 | Biegger | |
| 2014/0144803 | A1 | 5/2014 | Yamada | |

FOREIGN PATENT DOCUMENTS

| | | | | |
|---|---|---|---|---|
| CN | 103027624 | A | 4/2013 | |
| JP | 2006223455 | A | 8/2006 | |
| WO | 9417715 | A1 | 8/1994 | |
| WO | WO-2014200450 | A1 * | 12/2014 | B65D 5/2047 |

* cited by examiner

DISPENSER FOR ROLLED, PERFORATED, FOLDED, AND/OR INTERWOVEN BAGS, WIPES AND OTHER FLEXIBLE DISPENSIBLE MATERIALS

CROSS-REFERENCE TO RELATED APPLICATION

This application claims priority to U.S. Provisional Application No. 62/348,685, filed on Jun. 10, 2016, which is incorporated by reference in its entirety.

BACKGROUND OF THE INVENTION

1. Field of the Invention

The present invention relates to a dispenser of materials, and in particular to a dispenser for rolled, perforated, folded, and/or interwoven bags, paper towels, toilet paper, wipes, and other flexible dispensable materials.

2. Description of Prior Art

Dispensers in the form of containers are known in the art to have a single, generally rectangular slot through which paper towels, toilet paper, waste disposal bags, and the like are fed and dispensed. Typically, a user grasps a portion of the paper towel, toilet paper or bag, and then pulls the remaining portion through the rectangular slot.

In the prior art, the speed and force of the user pulling the material will often either break the material or will dispense too much of the material. Dispensers in the prior art lack a mechanism to slow the dispensation of the material to prevent breaking or over dispensing.

In addition, some materials such as paper towels, toilet paper or waste disposable bags are perforated, but the dispensing devices in the prior art require the user to identify the perforated line or the end of a unit of the material, such as a single sheet of paper towel or the temporary perforated joining of waste disposal bags. The user in such circumstances must also align the perforation with a divider or a tearing device, and then pull the material onto the tearing device to create a tear between units of material.

Unfortunately, such attempts to use tearing devices on dispensers in the prior art results in a perforation staying intact and/or a tear in the material in the wrong place. In the case of plastic bags, which are the typical composition of waste disposal bags, the inaccurate tearing process ruins the bags in the prior art.

Accordingly, dispensing devices in the prior art cannot be handheld in a single hand, since the user must often use two hands to grasp portions of the exposed material on either side of a perforation, in order to attempt to accurately tear the material at the perforation. If the user had been grasping the dispensing device with one hand, the user must then release the dispensing device, often allowing it to be loose and still feeding material due to any pulling forces while the user grasps the exposed material with two hands.

Furthermore, in the prior art, such dispensing devices, with or without tearing devices, often do not hold the next item for dispensing in a consistent, predictable and reachable position.

OBJECTS AND SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

The present invention provides a means to slow the dispensation to a manageable speed, allows for material to be pulled freely when pulling upward and grabs the material with enough strength to allow the user to pull and tear the desired item or material away from the dispenser when pulling downward. Additional material is not dispensed because it is blocked by the grabbed material, and importantly, the downward motion used to stop and tear the material is perpendicular to the motion required to pull material from the roll so it does not induce over-dispensing or additional spinning of the rolled material.

The present invention also provides a means to manage the speed at which rolled material is rolled out and once a full unit, such as a plastic bag, is outside the dispenser, the invention allows a user, with one downward motion, to simultaneously stop the dispensation, tear the bag at the perforated line, hold the next item in place and keep it there for the next time a dispensed item will be needed. Alternatively, if the invention is used in an upright container for other products such as baby wipes and cleansing towels, the motion would be rotated 90 degrees and therefore be a left, and then right, or forward, and then backward motion.

Thus, the present invention provides a dispensing device which includes a container retaining a dispensable material, which prevents breaking the material prior to dispensation or over dispensing too much of the material by including a mechanism to slow the dispensation of the material to prevent breaking or over dispensing. The dispensing device also aids in breaking the material subsequent to the material exiting the container. The user of the present invention does not need to identify the perforated line or the end of a unit of the material, such as a single sheet of paper towel or the temporary perforated joining of waste disposal bags, nor is the user required to align the perforation with a divider or a tearing device, and then pull the material onto the tearing device to create a tear between units of material at the appropriate locations, such as at perforations. Thus, tearing devices on dispensers in the prior art are not required in the present invention to properly tear the material in the right place, and so inaccurate tearing of material such as paper towels or waste disposal bags is avoided. Furthermore, the dispensing device of the present invention holds the next item for dispensing in a consistent, predictable, and reachable position.

In the dispensing device of the present invention, the container has a faceplate with at least three members forming a substantially triangular aperture through which the dispensable material is fed. The at least three members include a pair of opposing flanges forming the triangular aperture therebetween. The pair of opposing flanges further form a substantially linear slot therebetween and contiguous with the triangular aperture, with the dispensable material further fed through the slot. Each of the pair of opposing flanges has a curved surface forming a side of the triangular aperture. The at least three members further includes a first substantially linear member forming a first side of the triangular aperture, and the pair of opposing flanges form the second and third sides of the triangular aperture. Alternatively, the at least three members further includes first, second, and third substantially linear members forming a substantially rectangular aperture contiguous with the triangular aperture.

An interior surface, which may optionally be part of a cradle, is disposed within the container for releasably retaining the dispensable material through the aperture of the faceplate. The cradle has at least one curved surface facing the dispensable material for guiding the dispensable material toward the aperture of the faceplate. A roller is disposed within the container upon which the dispensable material is wound.

In use, a method for dispensing material from a container, having at least one interior surface and a faceplate, includes releasably retaining the material in a cradle formed by the at least one interior surface; and feeding the material through a substantially triangular aperture in the faceplate, with the substantially triangular aperture formed by at least three members of the faceplate. The method may also feed the material through a substantially linear slot formed by a pair of opposing flanges of the at least three members forming the triangular aperture, the slot being contiguous with the triangular aperture, and may also guide the material from the cradle to the triangular aperture by an interior surface of the cradle, with the interior surface facing the material.

BRIEF DESCRIPTION OF THE DRAWINGS

The foregoing summary, as well as the following detailed description of presently preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

Figure 1:
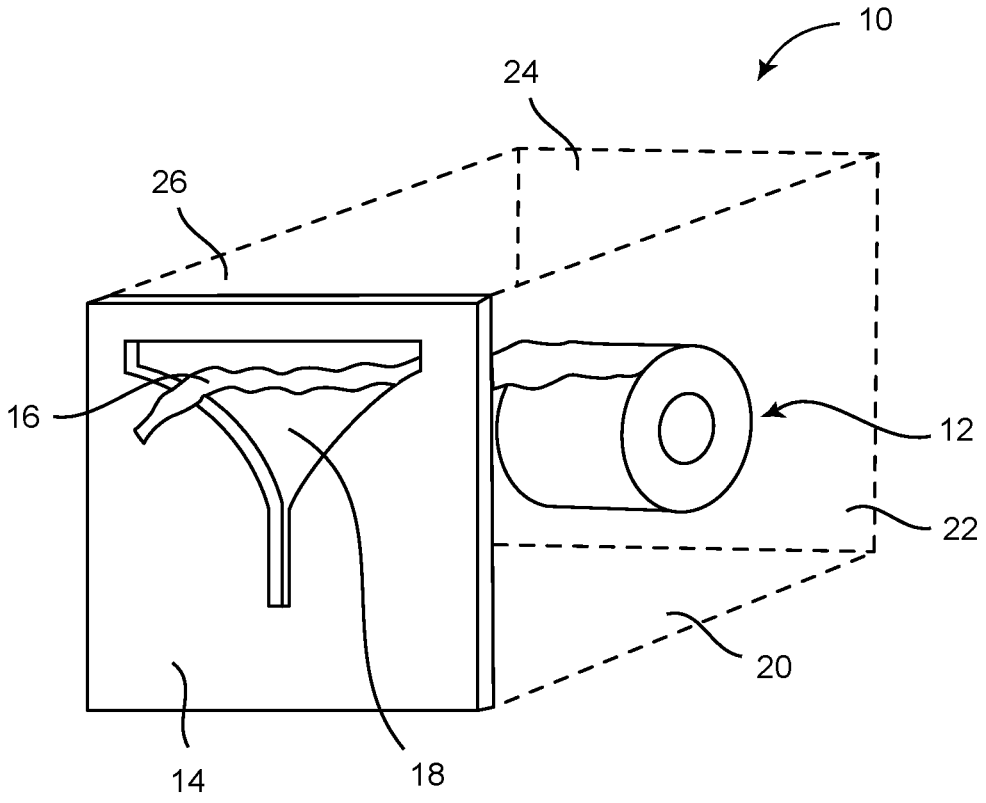
FIG. 1 is a front top side perspective cut-away view of a general dispenser of the present invention.

To facilitate an understanding of the invention, identical reference numerals have been used, when appropriate, to designate the same or similar elements that are common to the figures. Further, unless stated otherwise, the features shown in the figures are not drawn to scale, but are shown for illustrative purposes only.

DETAILED DESCRIPTION OF THE PREFERRED EMBODIMENTS

Certain terminology is used in the following description for convenience only and is not limiting. The article "a" is intended to include one or more items, and where only one item is intended the term "one" or similar language is used. Additionally, to assist in the description of the present invention, words such as top, bottom, upper, lower, front, rear, inner, outer, right and left are used to describe the accompanying figures. The terminology includes the words above specifically mentioned, derivatives thereof, and words of similar import.

FIG. 1 is a front top side perspective cut-away view of a general dispenser 10 of the present invention. The general dispenser 10 forms a container retaining the material 12, and the container includes a faceplate 14 through which the material 12 is fed and dispensed, such as by a user pulling on the exposed portion 16 of the material 12 extending through an aperture 18 in the faceplate 14. The material 12 may be rolled, perforated, folded, and/or interwoven bags, wipes, and other flexible dispensable materials, such as a roll of paper towels or other materials.

The dispenser 10 includes at least one other surface 20-26 for retaining and/or guiding the material to the aperture 18 for effective and careful dispensing, as described herein. The various surface or surfaces 20-26 are described in greater detail in connection with various embodiments of the general dispenser 10 of FIG. 1. For example, one or more of the other surfaces 20-26 forming the container of the dispenser 10 may be wall surfaces, such as interior portions of a wall through which only the faceplate 14 is exposed. Alternatively, the surfaces 20-26 and faceplate 14 may form a handheld container dimensioned to be held in one hand while the user is free to pull and dispense material 12 from the dispenser 10 with the user's free hand.

Figure 2:
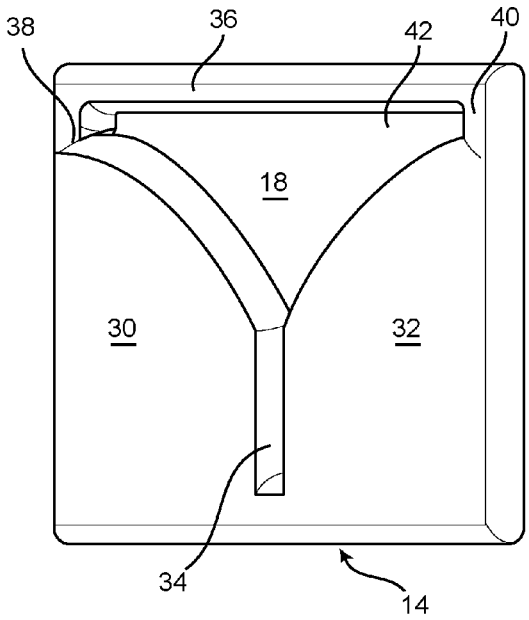
FIG. 2 is a front plan view of a faceplate of the general dispenser of FIG. 1.

FIG. 2 is a front plan view of a general faceplate 14 of the general dispenser 10 of FIG. 1. The faceplate 14 has at least three members forming a substantially triangular aperture 18 through which the dispensable material 12 is fed, such as the exposed portion 16. The three members include a pair of opposing flanges 30, 32 forming the triangular aperture therebetween. The pair of opposing flanges 30, 32 further form a substantially linear slot 34 therebetween and contiguous with the triangular aperture 18, with the dispensable material 12 further fed through the slot 34. Each of the pair of opposing flanges has a curved surface forming a side of the triangular aperture. The three members further include a first substantially linear member 36 forming a first side of the triangular aperture 18, and the pair of opposing flanges 30, 32 form the second and third sides of the triangular aperture 18. The curved edges of the triangular aperture 18 guide the material downward into the slot 34 while providing resistance for tearing the material. Alternatively, the edges of the faceplate 14 could be formed with a plurality of angled surfaces. The faceplate 14 described here is also applicable to the embodiments described below.

Alternatively, the three members further include the first member 36 as well as a second substantially linear member 38 and a third substantially linear member 40 forming a substantially rectangular aperture 42 contiguous with the triangular aperture 18. The aperture 18 and slot 34 of the faceplate 14 are formed with edges which are curved. The faceplate 14 does not include any sharp edges and therefore is safe for all users.

Figure 3:
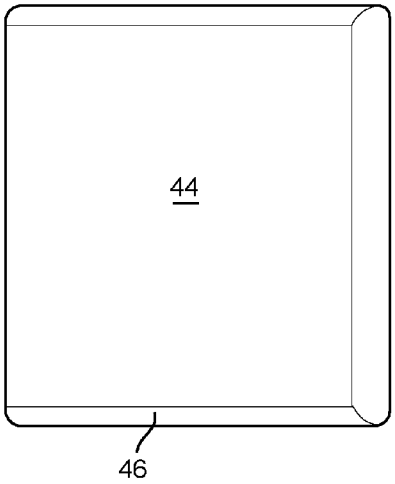
FIG. 3 is a plan view of a guide surface used in the general dispenser of FIG. 1.

FIG. 3 is a plan view of a guide plate 44 used in the general dispenser 10 of FIG. 1. In one embodiment, the guide plate 44 includes a guide surface 46 at a bottom portion thereof for retaining the material 22 thereupon, and possibly guiding the material 12 to be fed to the aperture 18 and/or the slot 34.

Figure 4:
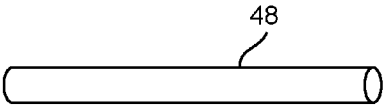
FIG. 4 shows a guide used in the general dispenser of FIG. 1.

Additional elements or members such as a guide 48, shown in FIG. 4, may be internally disposed in the dispenser 10 for forming a guide path through which the material 12 is fed to the aperture 18 and/or the slot 34. The guide 48 may be configured to rotate about a longitudinal axis, and thus the guide 48 may function as a guide bearing for material 12 being fed to the aperture 18 and/or the slot 34. The guide 48 could replace the guide plate 44 or could be used in conjunction with the guide plate 44 to further ensure that the material is substantially taut and to provide a desired angle of exit to the aperture 18 and/or slot 34. Moreover, a rotational guide 48 is particularly useful when minimal friction on the material 12 is desired. This configuration is desirable when the connection between the dispensed pieces of material 12 is weak, for example, when the material 12 is a perforated material that is folded as opposed to rolled, to minimize the possibility of a user inadvertently tearing the material along the perforations. In another example, a rotational guide 48 is also desirable when the material 12 is only folded together and not connected otherwise.

The guide plate 44 and/or guide 48 provides tension in the material 12 and assists the user in cutting the material 12. A space is formed between the faceplate 14 and guide plate 44 or guide 48. That space is typically 10-50 percent of the height of the faceplate 14 and provides a means for the material 12 to change direction and move at a predictable angle from its point of origin and to the various points on the faceplate 14. The guide plate 44 and/or guide 48 is positioned at a height well below the aperture 12. By the material 12 engaging the guide plate 44 and/or guide 48 at a sharp angle (see, e.g. FIG. 6), the dispensation of the material 12 is slowed and the material 12 is prevented from breaking before being dispensed. When the material 12 is pulled downward, the guide plate 44 and/or guide 48 also ensures that any new material 12 that enters the space between the faceplate 14 and guide plate 44 is guided toward the slot 34. The guide plate 44 and guide 48 described here are also applicable to the embodiments described below.

Alternatively, as shown in FIG. 1, the dispenser 10 could be constructed without a guide plate 44 or guide 48 and instead at least one surface 20-26 of the dispenser 10 could be used to guide the material 12 and provide sufficient tension to the end of the material 16. For example, the weight of the material 12 in rolled form could provide sufficient tension. As another example, the dispenser could be configured such that a rotational axis of the rolled material 12 is aligned with the faceplate 14 so that tension is created without an additional guide. Such a configuration could also be optimal for folded materials which do not require excessive tension for operating the dispenser 10.

Figure 5:
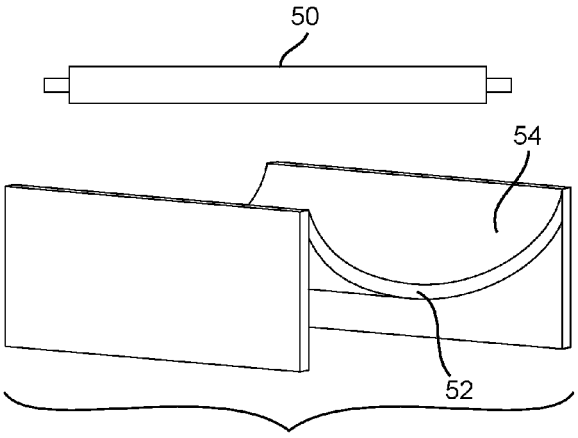
FIG. 5 shows an internal cradle and roller assembly used in the general dispenser of FIG. 1.

Alternatively or in addition, an internal cradle and roller assembly, as shown in FIG. 5, are used and disposed within the general dispenser 10 of FIG. 1. In particular, the material 12 may be wound on the roller 50, and the wound material 12 rests on the cradle 52. The material 12 slidably engages a guide surface 54 of the cradle 52 to be guided towards the aperture 18 and/or the slot 34.

Referring generally to FIGS. 1-5, in use, a method for dispensing material 12 from a container 10, having at least one interior surface 54 and the faceplate 14, includes releasably retaining the material 12 in the cradle 52 formed by the at least one interior surface 54; and feeding the material 12 through the substantially triangular aperture 18 in the faceplate 14, with the substantially triangular aperture 18 formed by at least three members of the faceplate 14. Upward pulling of the exposed material 16 through the aperture 18 allows the material 12 to be freely dispensed and the material 12 is torn to any desired length against the first member 36.

The method may also feed the material through the substantially linear slot 34 formed by the pair of opposing flanges 30, 32 of the at least three members forming the triangular aperture 18, with the slot 34 being contiguous with the triangular aperture 18, and may also guide the material 12 from the cradle 52 to the triangular aperture 18 and the slot 34 by the interior surface 54 of the cradle 52, with the interior surface 54 facing the material 12. When the user pulls the exposed material 16 downward, the material 12 is fed through the slot 34, which provides resistance and causes the material 12 fed through the slot 34 to tear at the appropriate pre-formed perforations in the material 12. In this alternative method, the material 12 is dispensed and torn to a desired length by applying a downward force against a bottom portion of the slot 34. Accordingly, upward feeding through the aperture 18 and then downward feeding through the slot 34 tears the material 12 without over dispensing or additional spinning and feeding of the material 12 from the roll thereof.

Figure 6:
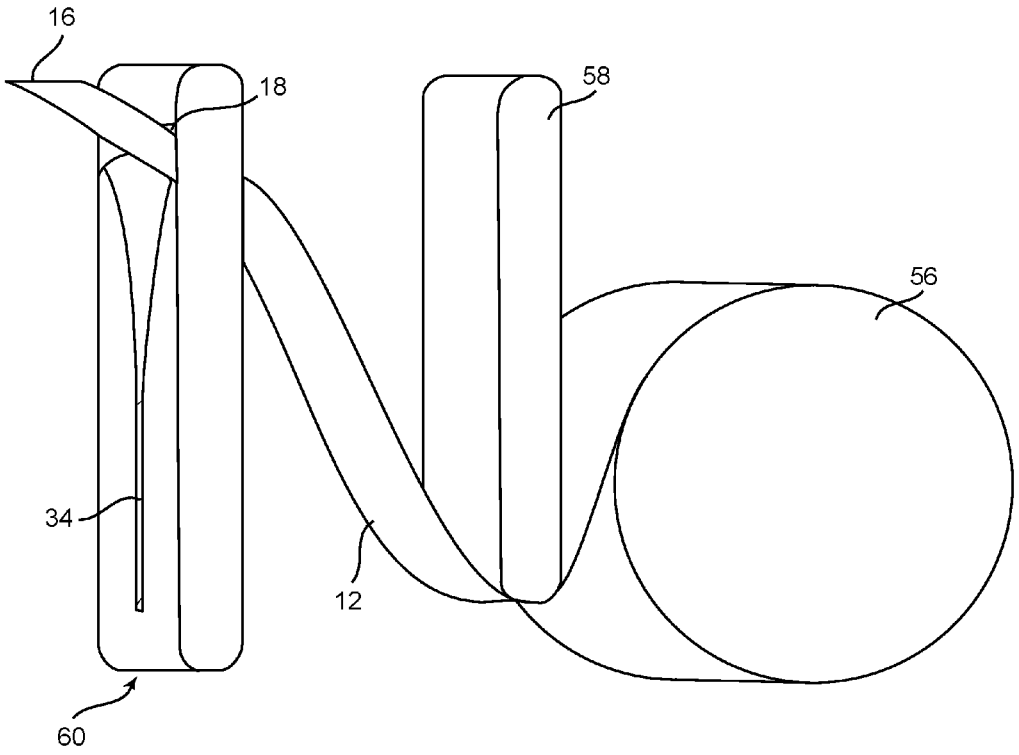
FIG. 6 shows a first alternative configuration of the general dispenser of FIG. 1.

FIG. 6 shows a first alternative configuration of the general dispenser 10 of FIG. 1, by which the material 12 is fed off of the wound roll 56 of material, and is guided by a guide member 58 internally disposed within the dispenser 10 toward the aperture 18 of the faceplate 60. As shown in FIG. 6, the faceplate 60 may be substantially identical to the faceplate in FIG. 2, but may be configured and dimensioned to have a narrower width of the faceplate 60, of the aperture 18, and/or of the slot 34, for example, to guide and dispense relatively narrow materials, such as gauze, movie tickets, adhesive tape, correction tape, etc., wound on relatively narrow rolls 56. As previously described, the material 12 could be torn with an upward force against a solid portion above the aperture 18.

Figure 7:
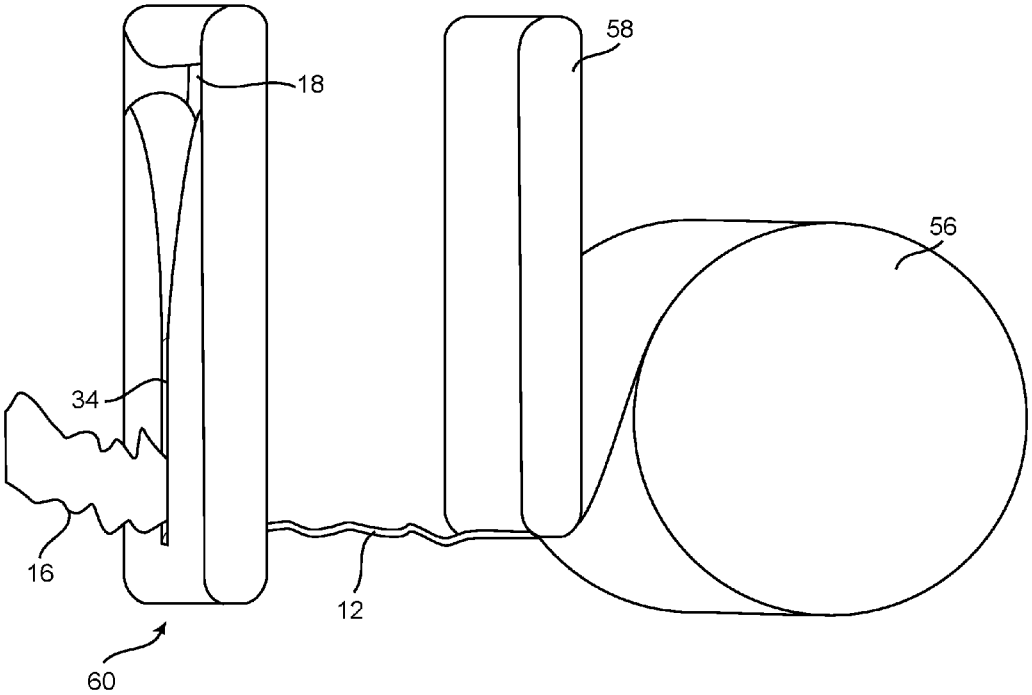
FIG. 7 shows a second alternative configuration of the general dispenser of FIG. 1.

FIG. 7 shows a second alternative configuration of the general dispenser 10 of FIG. 1, by which the material 12 is fed off of the wound roll 56 of material, and is guided by a guide member 58 internally disposed within the dispenser 10 toward the slot 34 of the faceplate 60. As previously described, the material 12 could be torn with an downward force against a solid portion below the slot 34.

Figure 8:
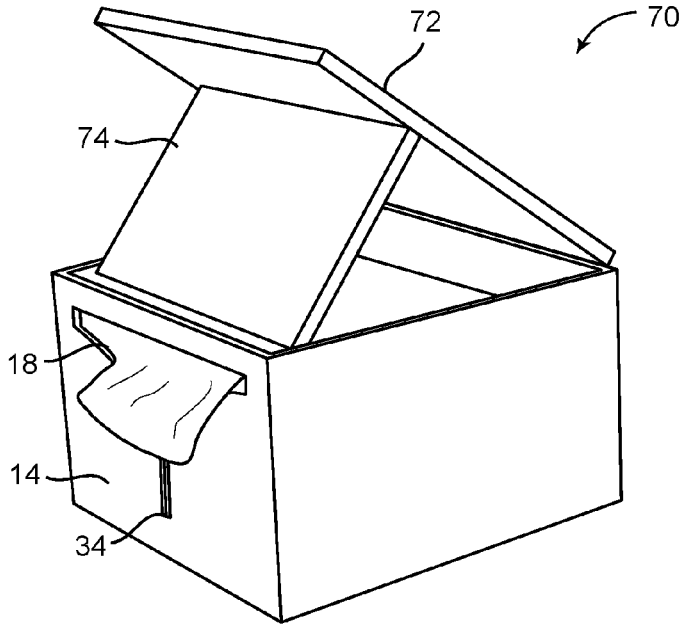
FIGS. 8-9 show a first embodiment of a dispenser of the present invention.
Figure 9:
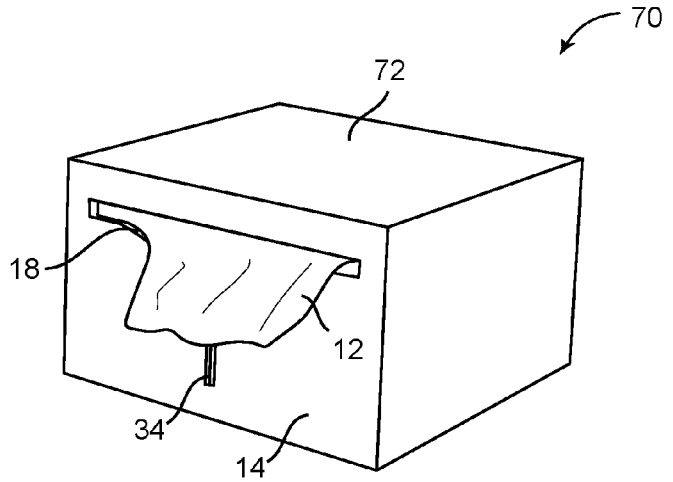

FIGS. 8-9 show a first embodiment of a dispenser 70 of the present invention, which has the faceplate 14 with aperture 18 and slot 34, and an upper surface 72 with a guide member 74 extending downward into the interior of the dispenser 70 to guide the material 12 in a manner as described in connection with the guide member 58 shown in FIGS. 6-7. The guide member 74 may be attached and secured to the underside of the upper surface 72 by adhesive, welding, or other fastening or attaching mechanism.

Figure 10:
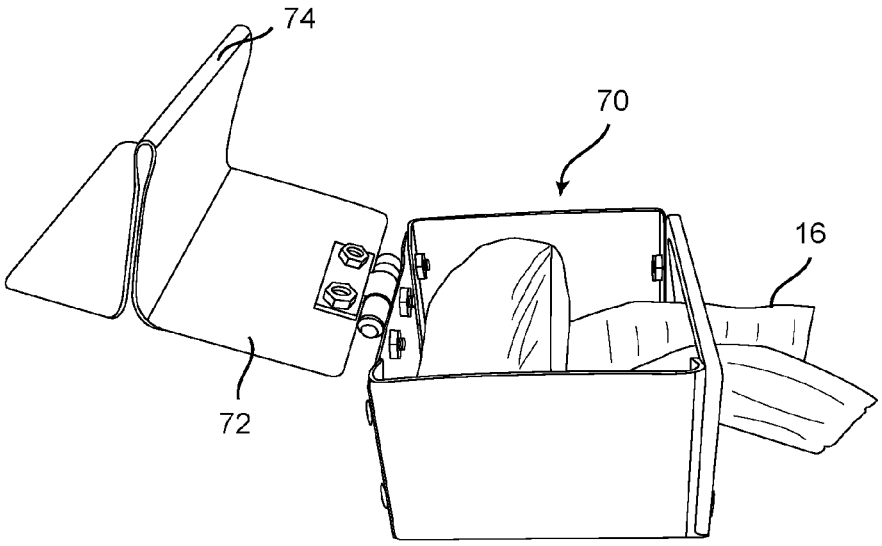
FIGS. 10-11 show an alternative configuration of the first embodiment of FIGS. 8-9.
Figure 11:
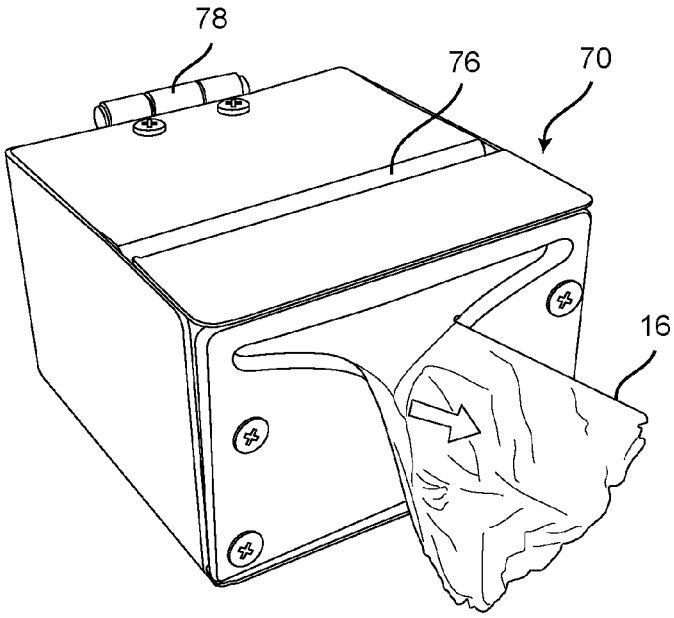

FIGS. 10-11 show an alternative configuration of the first embodiment of FIGS. 8-9, in which the guide member 74 is formed by folding the upper surface 72 instead of attaching a separate member to the upper surface 72 as the guide member 74. Accordingly, a crease 76 or other indentation in the upper surface 72 may result. In addition, the upper surface 72 may be attached to the other members of the dispenser 70 with a hinge 78 to facilitate opening the dispenser 70 to replace rolls of material 12 therein.

Figure 12:
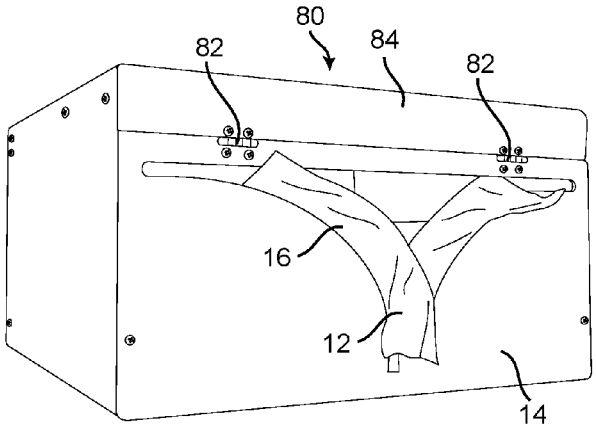
FIGS. 12-14 show a third embodiment of a dispenser of the present invention.
Figure 13:
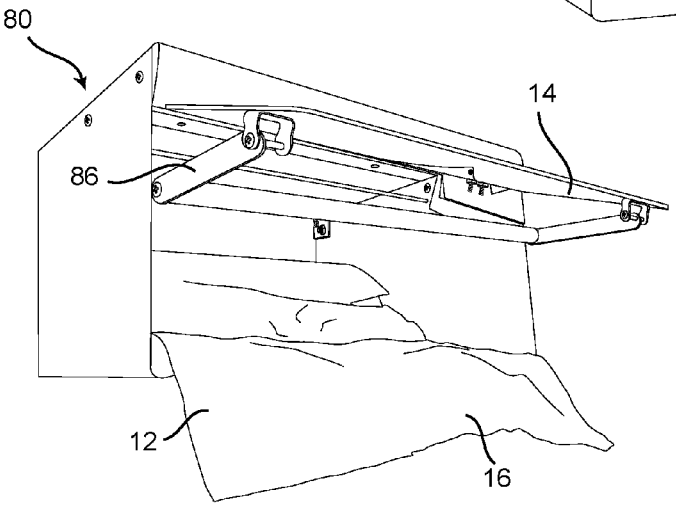
Figure 14:
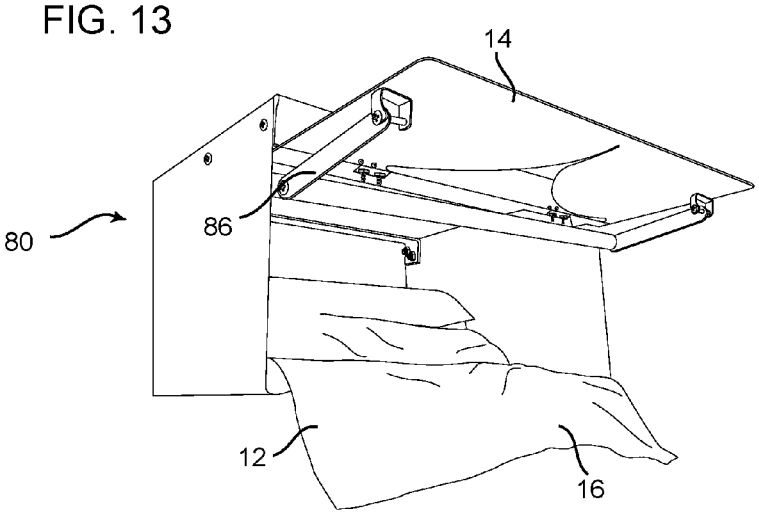

FIGS. 12-14 show a third embodiment of a dispenser 80 of the present invention, in which the faceplate 14, having the aperture 18 and slot 34, is attached via hinges 82 to an upper faceplate 84, allowing the faceplate 14 to be rotated to open the dispenser 80 for replace rolls of material 12 therein. Optionally, the dispenser 80 may include at least one arm mechanism 86 to releasably secure the faceplate 14 in an open configuration as shown in FIG. 14, allowing for ease of replacement of rolls of material 12 while the faceplate 14 is in the open configuration. Although not shown, a guide 48 such as that shown in FIG. 4 secures the material 12 at a bottom portion of the dispenser 80 and provides sufficient tension to the material 12 when the material free end 16 is pulled by the user.

Figure 15:
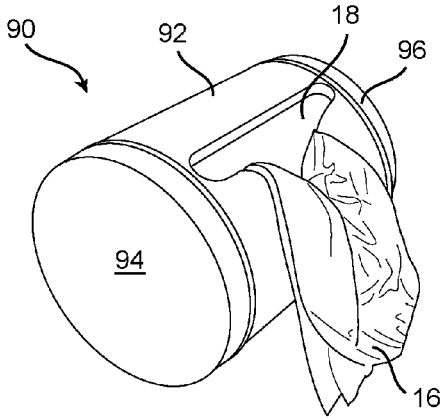
FIGS. 15-17 show a fourth embodiment of a dispenser of the present invention.
Figure 16:
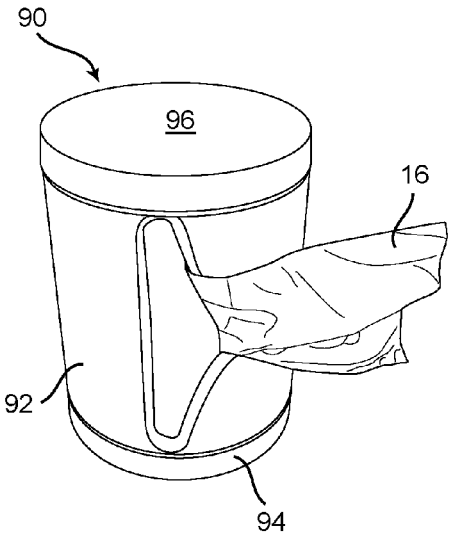
Figure 17:
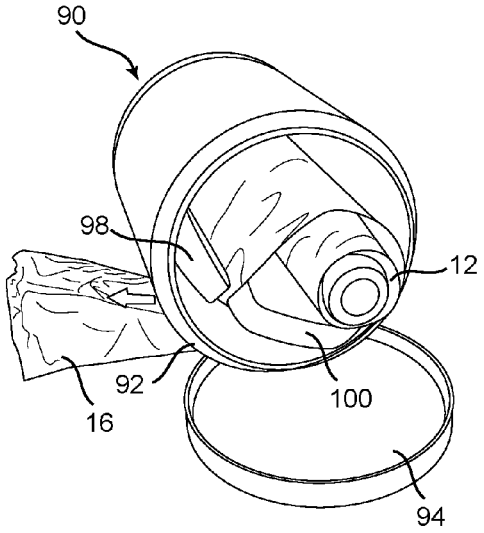

FIGS. 15-17 show a fourth embodiment of a dispenser 90 of the present invention, which has a generally cylindrical shape, including a faceplate 92 having a curved shape matching the curvature of other portions of the dispenser 90. Alternatively, the faceplate 92 forms the cylindrical sides of the dispenser 90, with the substantially triangular aperture 18 therethrough, and substantially planar side caps 94, 96. Internal to the dispenser 90, as shown in FIG. 17, at least one guide member 98, 100 is disposed to form a cradle for the roll of material 12, and to provide tension and guide the material 12 to the aperture 18. The dispenser 90 may also be dimensioned to be handheld.

Figure 18:
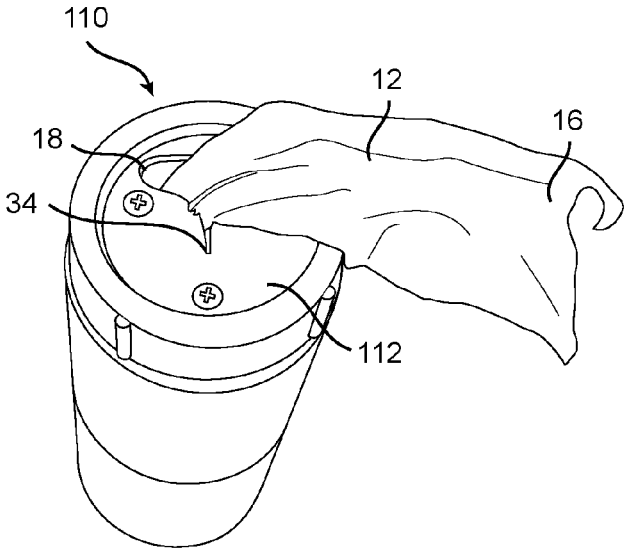
FIGS. 18-19 show a fifth embodiment of a dispenser of the present invention.
Figure 19:
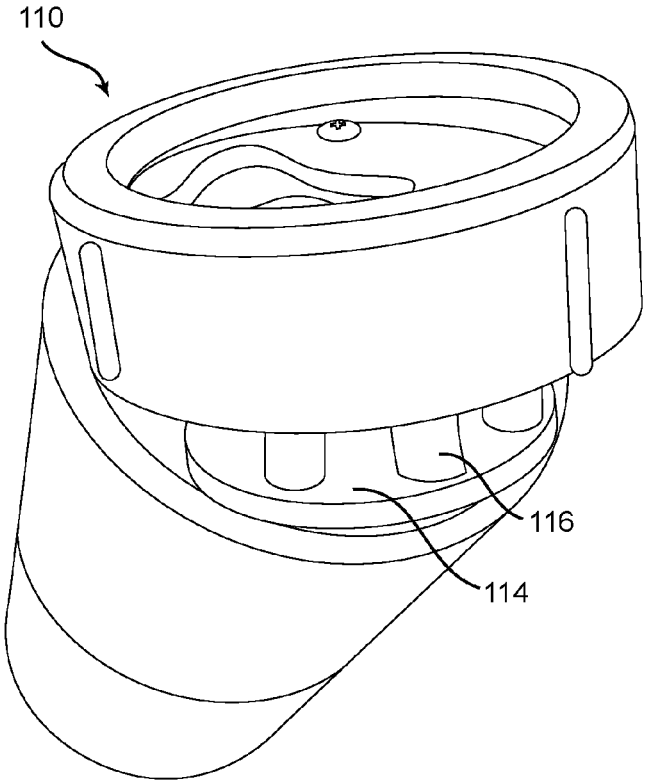

FIGS. 18-19 show a fifth embodiment of a dispenser 110 of the present invention, also with a substantially cylindrical shape, but with the material 12, 16 being fed through and dispensed from an aperture in a substantially planar faceplate 112 at one cap or end of the cylindrical dispenser 110. The faceplate 112 include a triangular aperture 18 and slot 34 as described above. The dispenser 110 may also be dimensioned to be handheld. In this embodiment, the dispenser includes a guide plate 114 positioned apart from and under the faceplate 112. The guide plate 114 includes an aperture 116 for which the material 12 is positioned to pass therethrough. In this manner, tension is created on the material free end 16 so that the material 12 is easily torn against the triangular aperture 18 and slot 34.

Figure 20:
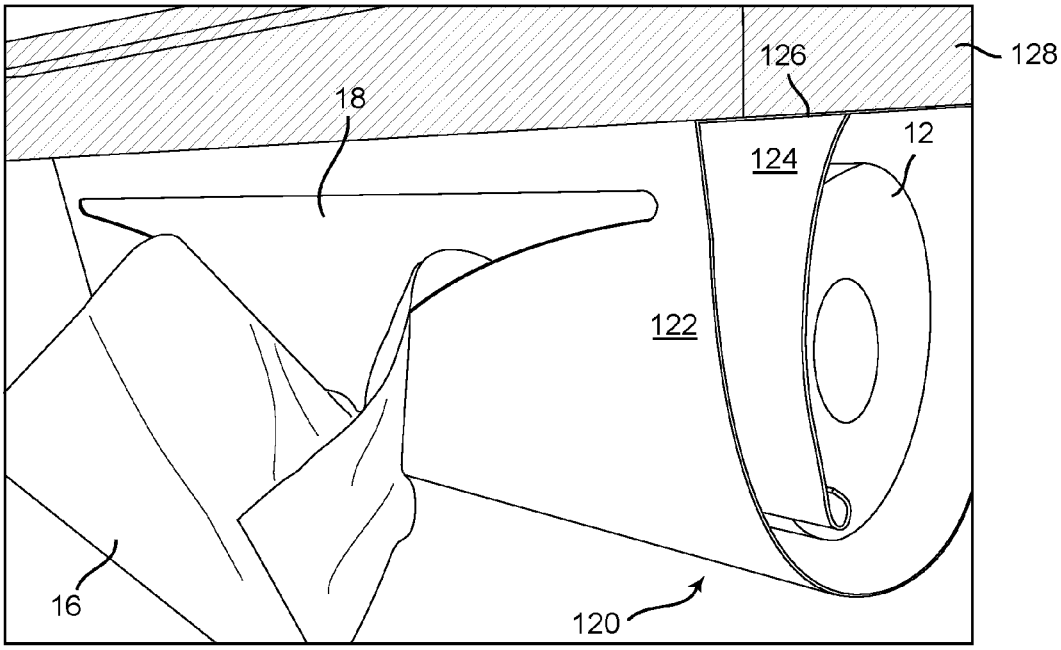
FIGS. 20-21 show a sixth embodiment of a dispenser of the present invention.
Figure 21:
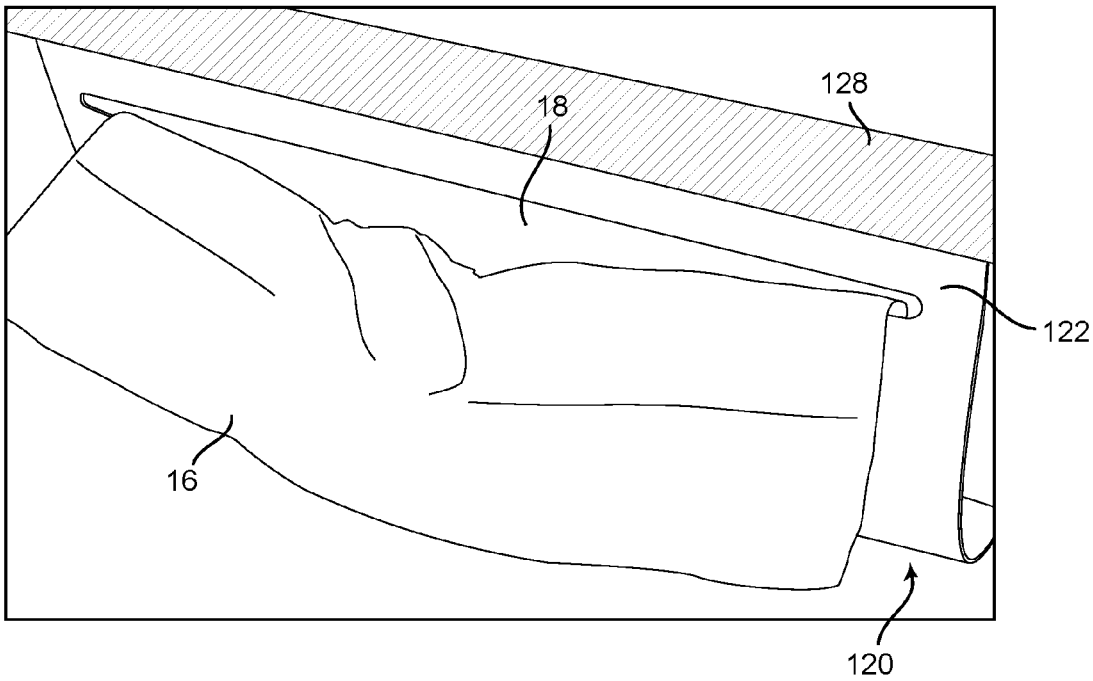

FIGS. 20-21 show a sixth embodiment of a dispenser 120 of the present invention, having a quasi-cylindrical shape or spiral shape. In one embodiment, the dispenser 120 is formed from a single sheet of guide material, such as metal, shaped plastic, wood, etc., fabricated, for example, by being the guide material into a spiral shape. Portions of the dispenser 120 form a faceplate section 122 having the aperture 18 therethrough, a guide section 124 for guiding the material 12, 16 to the aperture 18, and optionally a fastening section 126 for fastening the dispenser 120 to the underside of furniture or other structures, such as the underside of a kitchen cabinet 128. Accordingly, a portion of the fastening section 126 may be substantially planar to be flush with the underside of the kitchen cabinet to be fastened thereto by adhesives, screws, or other known fastening mechanisms.

Figure 22:
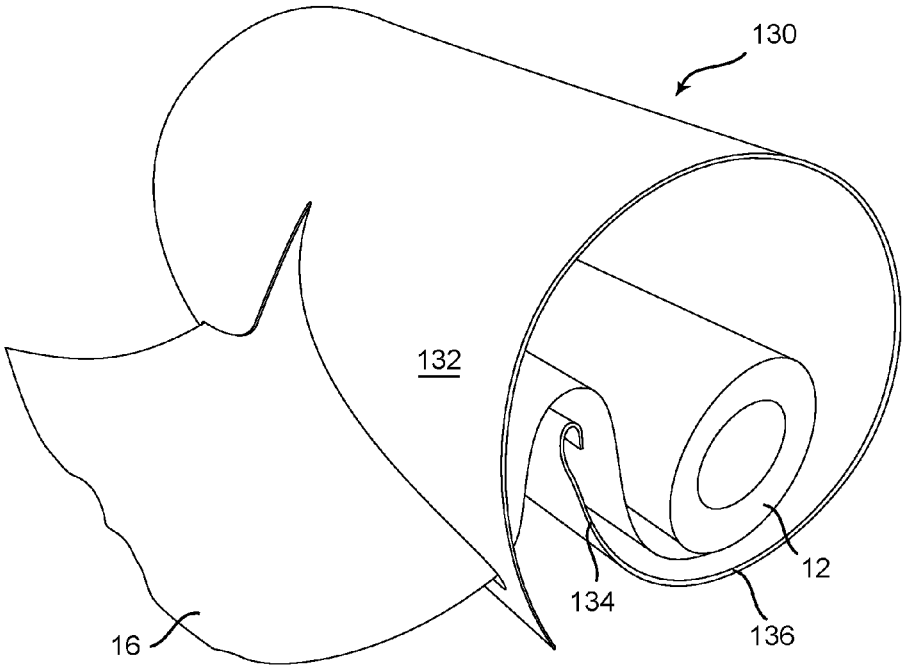
FIGS. 22-23 show a seventh embodiment of a dispenser of the present invention.
Figure 23:
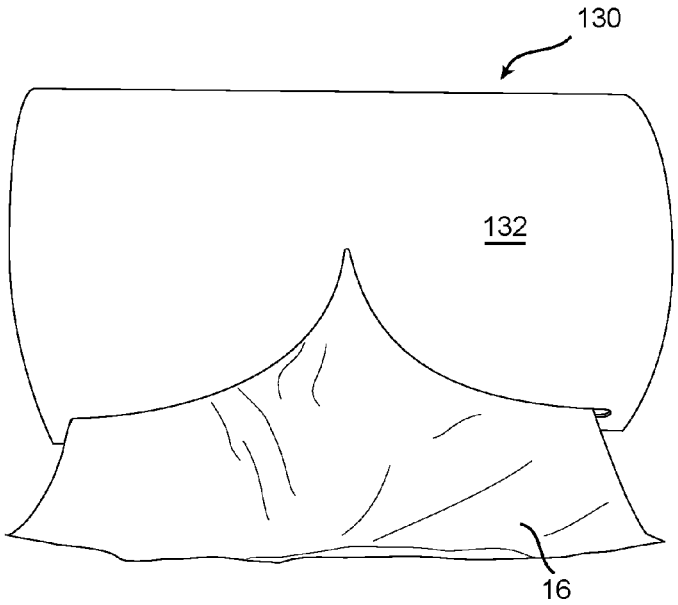

FIGS. 22-23 show a seventh embodiment of a dispenser 130 of the present invention, having a quasi-cylindrical or spiral shape similar to the dispenser 120 of FIGS. 20-21. However, in the seventh embodiment, the dispenser 130 is formed and oriented to be positioned substantially horizontally along its longitudinal length on a surface, such as a kitchen counter or other furniture. Portions of the dispenser 130 form a faceplate section 132 having the aperture 18 therethrough, a guide section 134 for guiding the material 12, 16 to the aperture 18, and optionally a base section 136 for resting the dispenser 130 on furniture or other structures, such as the kitchen counter. Accordingly, a portion of the base section 136 may be substantially planar to be flush with the top surface of the furniture, and optionally to be fastened thereto by adhesives, screws, or other known fastening mechanisms.

Figure 24:
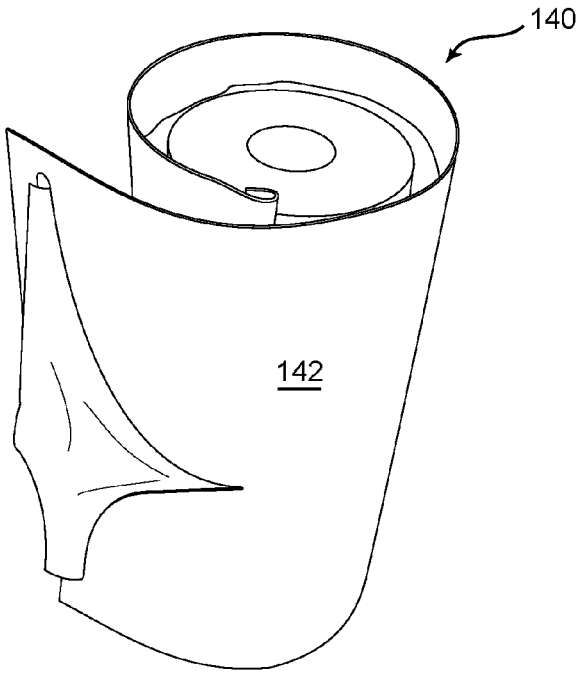
FIGS. 24-25 show an eighth embodiment of a dispenser of the present invention.
Figure 25:
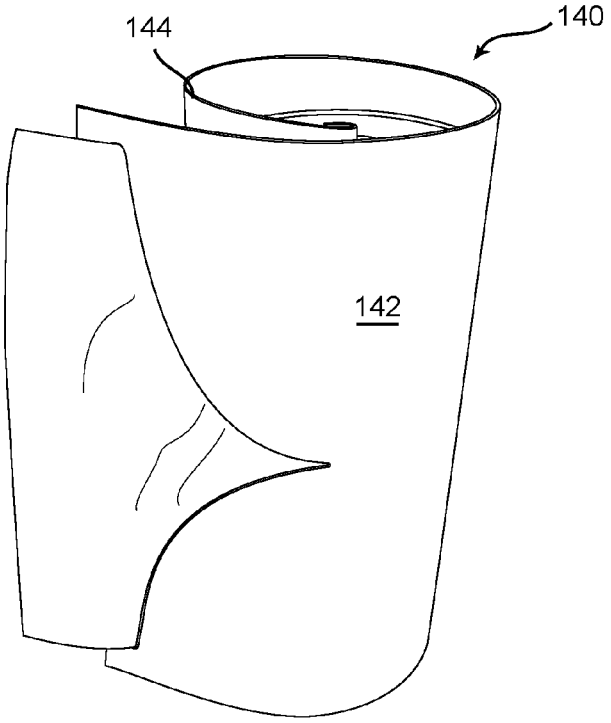

FIGS. 24-25 show an eighth embodiment of a dispenser 140 of the present invention, having a quasi-cylindrical or spiral shape similar to the dispensers 120, 130 of FIGS. 20-23. However, in the eighth embodiment, the dispenser 140 is formed and oriented to be positioned on a surface, such as a kitchen counter or other furniture, with an end of the dispenser 140 resting on the surface. Portions of the dispenser 140 form a faceplate section 142 having the aperture 18 therethrough, and a guide section 144 for guiding the material 12, 16 to the aperture 18. Optionally a base section may be placed at the end of the dispenser 140 for resting the dispenser 140 on furniture or other structures, such as the kitchen counter. Accordingly, a portion of the base section may be substantially planar to be flush with the top surface of the furniture, and optionally to be fastened thereto by adhesives, screws, or other known fastening mechanisms.

Figure 26:
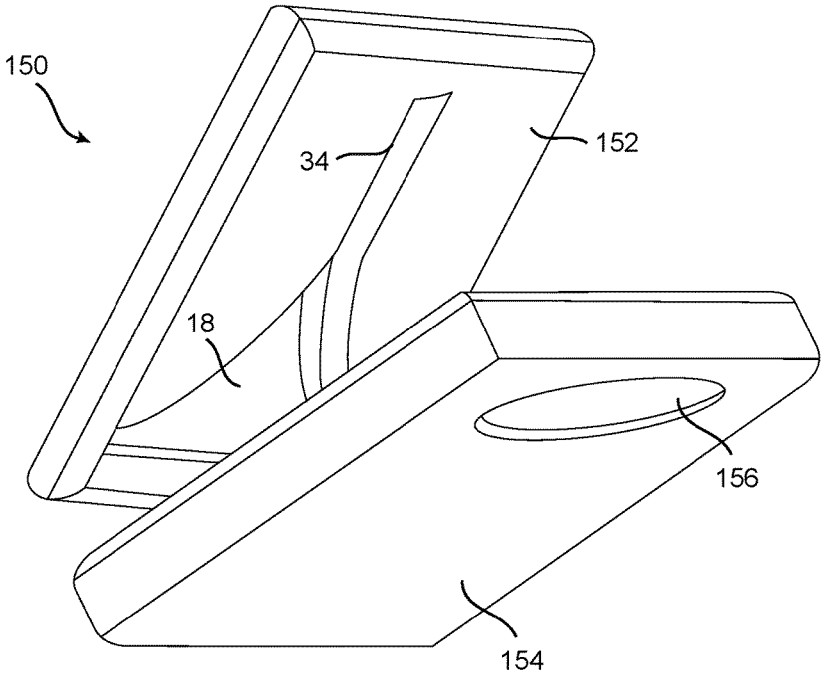
FIG. 26 shows a ninth embodiment of a dispenser of the present invention.
Figure 26A:
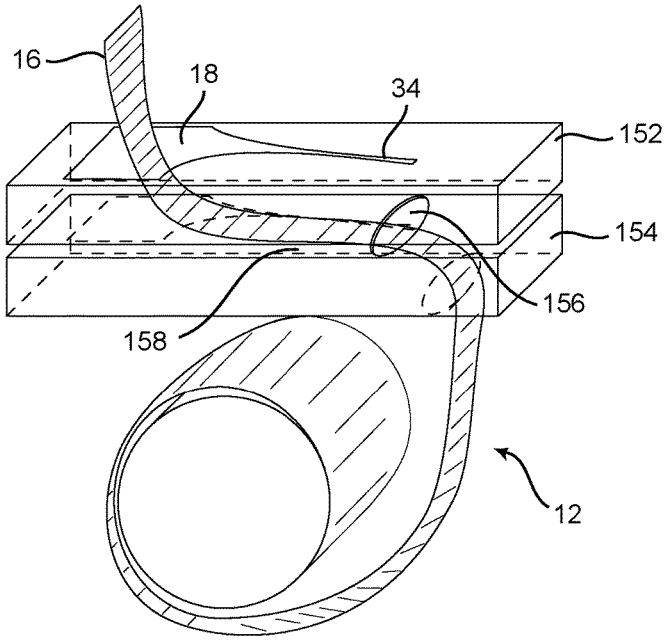
FIG. 26A shows a dispenser of FIG. 26 in use.

FIGS. 26 and 26A show a ninth embodiment of a dispenser 150 of the present invention, formed with a faceplate 152 and a base plate 154 positioned against each other. The faceplate 152 is substantially similar to the faceplate 14 described above. The base plate 154 includes a bottom aperture 156 extending through the depth of the base plate 154. A surface of the base plate 154 which engages the faceplate 152 includes a concave portion 158 adjacent to the aperture 156 to form a cavity or tunnel between the faceplate 152 and base plate 154. In operation, a roll of material 12 is fed through the bottom aperture 156, the concave portion 158 on the base plate 154 and the faceplate aperture 18. The dispenser 150 in this embodiment is ideal for plastic bags, paper and rolled material.

Figure 27:
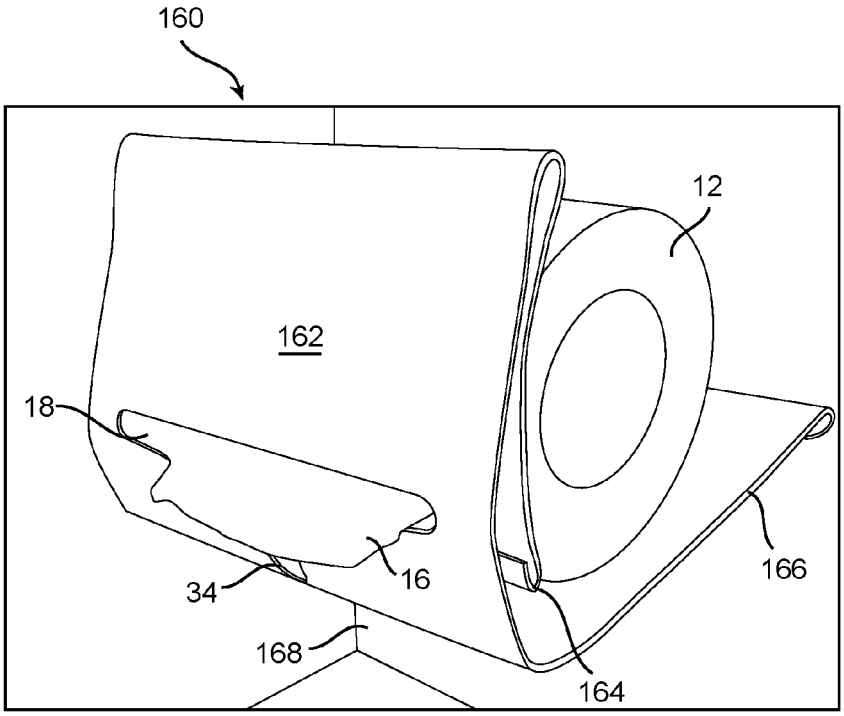
FIG. 27 shows a tenth embodiment of a dispenser of the present invention.

FIG. 27 shows a tenth embodiment of a dispenser 160 of the present invention, having a faceplate 162, a guide member 164, and a base plate 166. The base plate 166 retains the roll of material 12 and also allows the dispenser 160 to rest on a surface, such as a bathroom counter. Optionally, the base plate 166 is attached to and/or is a portion of a larger base structure 168 which rests on the surface. The dispenser 160 may be composed of a single sheet of metal or formed plastic, and optionally may be integrally formed with the larger base structure 168. In this embodiment, the aperture 18 and slot 34 are rounded so that the material end portion 16 could be easily retrieved in the event the end portion 16 is positioned within the faceplate 162. In this embodiment, the material 12 could be toilet paper but other materials could be used as well.

Figure 28:
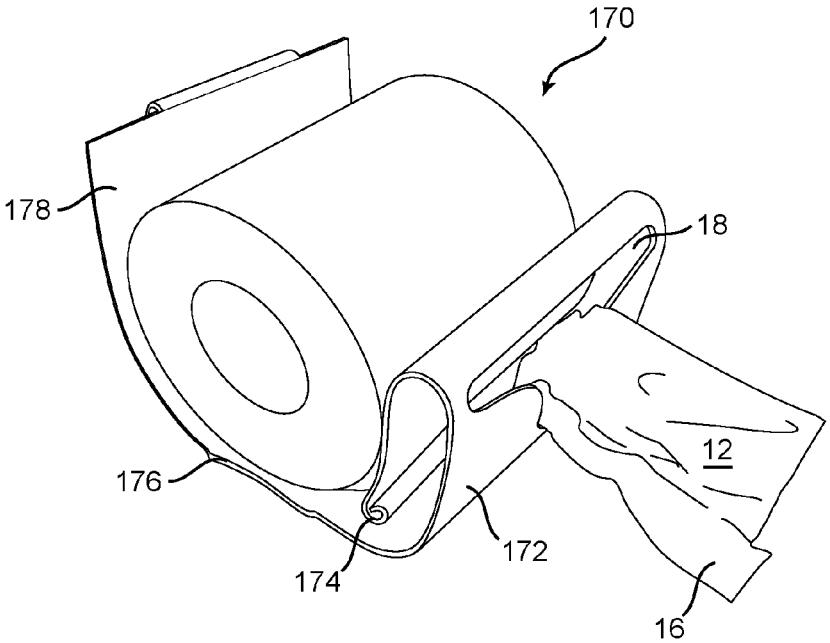
FIG. 28 shows an eleventh embodiment of a dispenser of the present invention.

FIG. 28 shows an eleventh embodiment of a dispenser 170 of the present invention, having a faceplate 172, a guide member 174, and a base plate 176, as well as a back plate 178, with the plates 174-178 forming a cradle for holding the roll of material 12 similar to the cradle 52 in FIG. 5. The dispenser 170 in FIG. 28 may be composed of a single sheet of metal or formed plastic, and optionally may be integrally formed with or attached to a larger base structure to rest on a surface, such as a bathroom counter. In this embodiment, the aperture 18 and slot 34 are rounded so that the material end portion 16 could be easily retrieved in the event the end portion 16 is positioned within the faceplate 172. In this embodiment, the material 12 could be toilet paper but other materials could be used as well.

In the embodiments shown in FIGS. 20-26, 27 and 28, each guide plate is curved to reduce friction and to focus pressure on the guide edge. The guide plate is extended such that the guide edge is positioned at or near the slot 34. In this manner, the material 12 is prevented from falling back into the dispenser after the material 12 is cut or ripped.

In further embodiments, the dispensers of the present invention may be mounted on stands, and may have appropriate removable portions for replacing the rolls of materials. Further embodiments of the dispenser of the present invention are not limited to rolls of materials, but may also accommodate stacks of flattened, folded, or sheet-like material to be dispensed one at a time. Such stacks of materials include baby wipes, large format tissues, towelettes, napkins, cleansing wipes, etc.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A dispensing device comprising:

a container retaining a dispensable material, the container having a faceplate with at least three members forming a substantially triangular aperture through which the dispensable material is fed, the faceplate having a terminating slot at one vertex of the aperture;

a guide member positioned behind, and guiding the material towards, the vertex of the aperture with the terminating slot, said guide member having a smooth surface and positioned near a lower portion of the faceplate and away from a wider portion of the aperture such that the guide member forces the material to turn at a sharp angle and in a controlled manner when pulled upward and out through the wider portion of the aperture; and a space between the faceplate and the guide member, with the space allowing the material to be pulled upward towards the wider opening or downward towards the terminating slot.

2. A dispensing device comprising:

a container retaining a dispensable material, the container having:

a faceplate with at least three members forming a substantially triangular aperture through which the dispensable material is fed, the faceplate having a terminating slot at one vertex of the aperture; and an interior surface forming a cradle within the container for releasably retaining the dispensable material through the aperture of the faceplate; and a guide member positioned behind, and guiding the material towards, the vertex of the aperture with the terminating slot, said guide member having a smooth surface and positioned near a lower portion of the faceplate and away from a wider portion of the aperture such that the guide member forces the material to turn at a sharp angle and in a controlled manner when pulled upward and out through the wider portion of the aperture; and a space between the faceplate and the guide member, with the space allowing the material to be pulled towards the wider opening or downward towards the terminating slot.

3. A method for dispensing material from a container having at least one interior surface and a faceplate, the method comprising:

releasably retaining the material in a cradle formed by the at least one interior surface;

feeding the material through a substantially triangular aperture in the faceplate, the aperture having a terminating slot at one vertex of the aperture, with the substantially triangular aperture formed by a least three members of the faceplate;

positioning a guide member behind the vertex of the aperture with the terminating slot;

forming a space between the faceplate and the guide member;

guiding the dispensable material, using the guide member, towards the vertex of the aperture with the terminating slot, said guide member having a smooth surface and positioned near a lower portion of the faceplate and away from a wider portion of the aperture such that the guide member forces the material to turn at a sharp angle and in a controlled manner when pulled upward and out through the wider portion of the aperture; and allowing, using the space, the dispensable material to be pulled upward towards the wider opening or downward towards the terminating slot.

* * * * *